US011549500B2

(12) United States Patent
Stratulate et al.

(10) Patent No.: US 11,549,500 B2
(45) Date of Patent: Jan. 10, 2023

(54) DOUBLE ACTING FLUID END

(71) Applicant: GARTECH, LLC, Houston, TX (US)

(72) Inventors: Gary Warren Stratulate, Houston, TX (US); Gary Pendleton, Shotley Bridge (GB)

(73) Assignee: GARTECH, LLC, Houston, TX (US)

( * ) Notice: Subject to any disclaimer, the term of this patent is extended or adjusted under 35 U.S.C. 154(b) by 0 days.

(21) Appl. No.: 17/104,412

(22) Filed: Nov. 25, 2020

(65) Prior Publication Data

US 2022/0163028 A1 May 26, 2022

(51) Int. Cl.
*F04B 39/12* (2006.01)
*F04B 53/16* (2006.01)

(52) U.S. Cl.
CPC ..... *F04B 39/12* (2013.01); *F04B 53/16* (2013.01)

(58) Field of Classification Search
CPC .. F04B 39/12; F04B 53/16; F04B 5/02; F04B 39/122; F16K 27/0209
USPC ..... 137/315.33
See application file for complete search history.

(56) References Cited

U.S. PATENT DOCUMENTS 35,609 A * 6/1862 Henry
616,849 A * 12/1898 Kimes
746,344 A * 12/1903 Krohn
1,308,288 A * 7/1919 McCain ..... F04B 39/1033 137/454.4
2,025,142 A * 12/1935 Zahm ..... F04B 39/062 417/438
3,602,247 A * 8/1971 Bunn ..... F04B 39/1013 137/270
5,156,537 A * 10/1992 Massinon ..... F04B 5/02 417/536
6,655,935 B2 * 12/2003 Bennitt ..... F04B 39/0016 417/523
2019/0264683 A1 * 8/2019 Smith ..... F04B 1/0538

* cited by examiner

*Primary Examiner* — Bryan M Lettman
(74) *Attorney, Agent, or Firm* — Ewing & Jones, PLLC

(57) ABSTRACT

A fluid end that provides for fluid transference in a double acting configuration. The fluid end acts for both suction and discharge operations and wherein fluid is ejected from the fluid end for high pressure environments.

6 Claims, 12 Drawing Sheets

DOUBLE ACTING FLUID END

CROSS-REFERENCE TO RELATED APPLICATIONS

None.

FIELD OF THE DISCLOSURE

Aspects of the disclosure relate to fluid handling. More specifically, aspects of the disclosure relate to a fluid end used in a high pressure fluid delivery system that converts performance functions of a single acting pump to that of a double acting pump.

BACKGROUND

Fluid ends are used to transfer hydraulic fluid for high pressure systems. Such high pressure systems can be used in a variety of locations, such as, for example, hydraulic fracturing apparatus used in hydrocarbon recovery operations. A fluid is pumped to a downhole location where the high pressure fluid interacts with the geological stratum, causing fissures. These fissures are held open by materials called proppants, thereby preventing closure of the fissures. Hydrocarbons locked in the geological stratum may then be released into the formed fissures, allowing operators to capture and collect the hydrocarbons.

As fluid ends are subject to very high stress, fluid ends can degrade quickly, causing an outage of operations. During the drilling and completion work for a well, daily operations can be very expensive, thereby necessitating that equipment used during these processes be very reliable. While there is a need for such reliable equipment, the reality of such maintenance free and defect free operation is not always attained. Fluid ends can fail in many situations, including material failures, gasket failures, bolting failures. As fluid ends are so critical, it is desired to provide a fluid end that performs at a highly efficient rate.

There is a need to provide an apparatus and methods that are easier to operate than conventional fluid end apparatus and methods.

There is a further need to provide apparatus and methods that do not have the material and design drawbacks discussed above.

There is a still further need to reduce economic costs associated with operations and apparatus described above with conventional fluid end.

There is a still further need to ease maintenance activities for fluid ends, thereby making field operations more economical.

SUMMARY

So that the manner in which the above recited features of the present disclosure can be understood in detail, a more particular description of the disclosure, briefly summarized below, may be had by reference to embodiments, some of which are illustrated in the drawings. It is to be noted that the drawings illustrate only typical embodiments of this disclosure and are therefore not to be considered limiting of its scope, for the disclosure may admit to other equally effective embodiments without specific recitation. Accordingly, the following summary provides just a few aspects of the description and should not be used to limit the described embodiments to a single concept.

In one example embodiment, an arrangement is disclosed. The arrangement may comprise a block with at least one void. The arrangement may further comprise a piston located within the at least one void in the block, the piston configured to translate from a first position to a second position. The arrangement may further comprise a first housing connected to the block, the first housing having a suction side and a discharge side. The arrangement may further comprise a second housing connected to the block, the second housing having a suction and a discharge side. The arrangement may further comprise at least a first suction check valve and a first discharge check valve located in the first housing. The arrangement may further comprise at least a second suction check valve and a second discharge check valve located in the second housing.

In another example embodiment, an arrangement is disclosed. The arrangement may comprise a first block for a first fluid end with at least one void and a second block for a second fluid end with at least one void. The arrangement may further comprise a piston located between the first fluid end and the second fluid end, the piston configured to translate from a first position to a second position. The arrangement may also comprise a first housing connected to the first block, the first housing having a suction side and a discharge side. The arrangement may also comprise a second housing connected to the second block, the second housing having a suction and a discharge side. The arrangement may also comprise at least a first suction check valve and a first discharge check valve located in the first housing. The arrangement may also comprise at least a second suction check valve and a second discharge check valve located in the second housing.

In another example embodiment, a method is disclosed. The method may provide for providing a fluid stream to a first fluid end. The method may also provide for passing the fluid stream through a first check valve. The method may also provide for actuating a piston to direct the fluid stream to a desired discharge of the first fluid end. The method may also provide for passing the fluid stream through a second check valve in the desired discharge. The method may also provide for passing the fluid stream through a remainder of the desired discharge.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the drawings. It is to be noted, however, that the appended drawings illustrate only typical embodiments of this disclosure and are therefore not be considered limiting of its scope, for the disclosure may admit to other equally effective embodiments.

Figure 1:
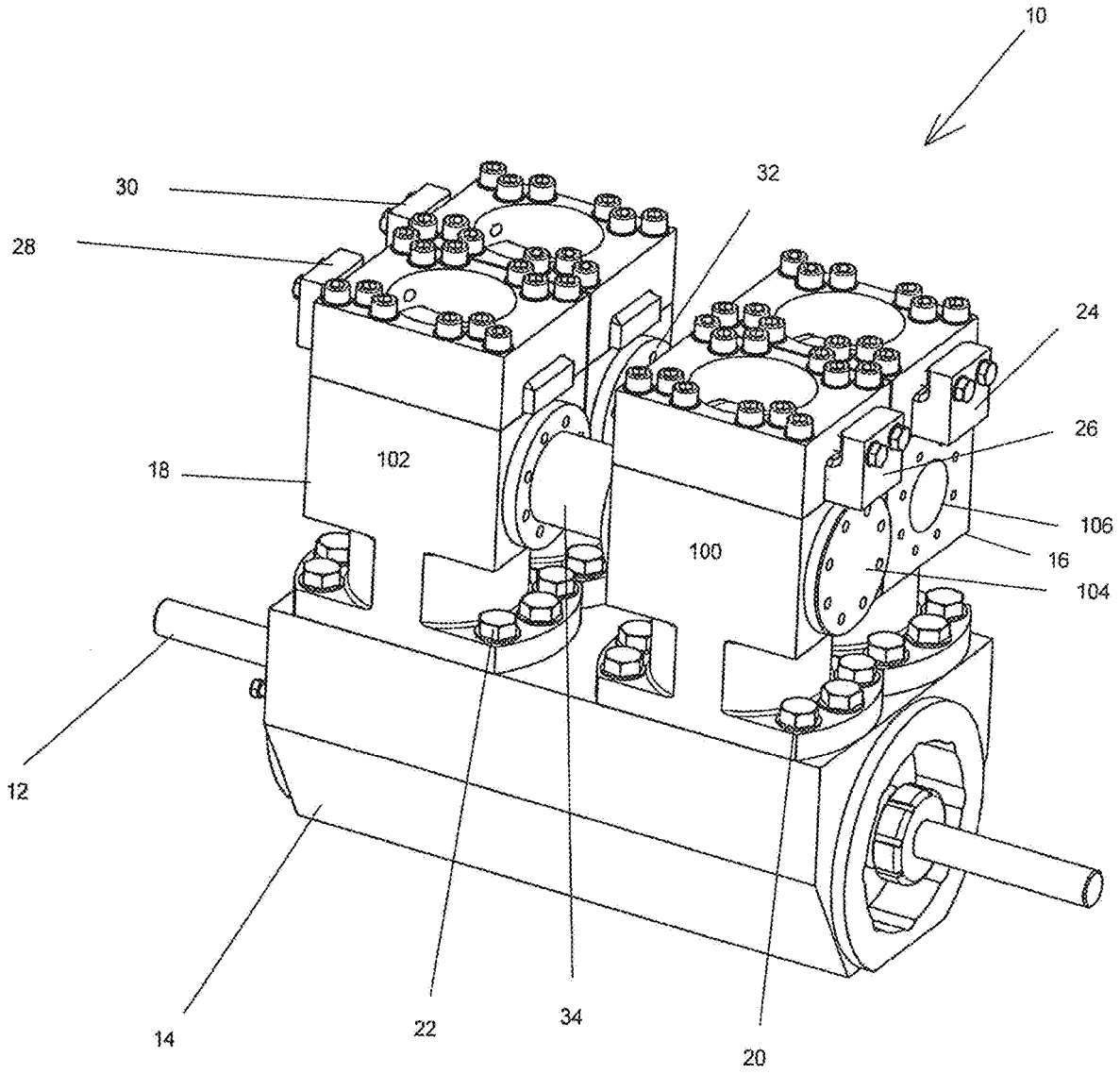
FIG. 1 is a perspective view of a double acting fluid end in one non-limiting example embodiment of the disclosure.

To facilitate understanding, identical reference numerals have been used, where possible, to designate identical elements that are common to the figures ("FIGS"). It is contemplated that elements disclosed in one embodiment may be beneficially utilized on other embodiments without specific recitation.

DETAILED DESCRIPTION

In the following, reference is made to embodiments of the disclosure. It should be understood, however, that the disclosure is not limited to specific described embodiments. Instead, any combination of the following features and elements, whether related to different embodiments or not, is contemplated to implement and practice the disclosure. Furthermore, although embodiments of the disclosure may achieve advantages over other possible solutions and/or over the prior art, whether or not a particular advantage is achieved by a given embodiment is not limiting of the disclosure. Thus, the following aspects, features, embodiments and advantages are merely illustrative and are not considered elements or limitations of the claims except where explicitly recited in a claim. Likewise, reference to "the disclosure" shall not be construed as a generalization of inventive subject matter disclosed herein and should not be considered to be an element or limitation of the claims except where explicitly recited in a claim.

Although the terms first, second, third, etc., may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first", "second" and other numerical terms, when used herein, do not imply a sequence or order unless clearly indicated by the context. Thus, a first element, component, region, layer or section discussed herein could be termed a second element, component, region, layer or section without departing from the teachings of the example embodiments.

When an element or layer is referred to as being "on," "engaged to," "connected to," or "coupled to" another element or layer, it may be directly on, engaged, connected, coupled to the other element or layer, or interleaving elements or layers may be present. In contrast, when an element is referred to as being "directly on," "directly engaged to," "directly connected to," or "directly coupled to" another element or layer, there may be no interleaving elements or layers present. Other words used to describe the relationship between elements should be interpreted in a like fashion. As used herein, the term "and/or" includes any and all combinations of one or more of the associated listed terms.

Some embodiments will now be described with reference to the figures. Like elements in the various figures will be referenced with like numbers for consistency. In the following description, numerous details are set forth to provide an understanding of various embodiments and/or features. It will be understood, however, by those skilled in the art, that some embodiments may be practiced without many of these details, and that numerous variations or modifications from the described embodiments are possible. As used herein, the terms "above" and "below", "up" and "down", "upper" and "lower", "upwardly" and "downwardly", and other like terms indicating relative positions above or below a given point are used in this description to more clearly describe certain embodiments.

Embodiments of the disclosure relate to a double acting fluid end 10. The double acting fluid end arrangement seeks to increase pressure while maintaining flow rate utilizing a current pump mechanism (with the performance limits of the pump). As will be understood, numerous pump mechanisms exist in the field and utilization of these existing mechanisms in the field may achieve increased efficiency of field operations. In embodiments, a piston that translates within a block is connected to a pump, for example, and the piston action provides flow and pressure in both the forward (conventional) pumping direction as well as the reverse (pull) direction of the mechanism. In these embodiments, therefore, a "double action" is performed wherein actuation of fluid is achieved in both pushing and pulling motions. In embodiments, the performance of a single action pump may be converted into a double action pump, wherein both motions of a piston may be advantageously used compared to conventional apparatus that have no such capability. In embodiments, available horsepower of a single acting pump are not exceeded, but rather advantageously used. Such use of available horsepower allows for efficient fluid handling. In embodiments, either flow or pressure may be increased in performance. Subject to horsepower limits, both flow and pressure may be augmented. The reason for this is to provide either an increase in flow or pressure, or maybe even a combination of both as long as the increases fall within the HP limits of the pump.

Referring to FIG. 1, a perspective view of a double acting fluid end 10 is illustrated. The double acting fluid end 10 allows for fluid flow through the fluid end 10 during reciprocation of a piston 12 placed within a fluid end block 14. The piston 12, in one non-limiting embodiment, may be actuated by a mechanical actuator, such as a reciprocating pump.

In embodiments, a suction line portion 106 and a discharge line portion 104 are provided to the double acting fluid end 10. The suction line portion 106 provides for intake of fluid into the double acting fluid end 10. The discharge line portion 104 provides for an exit of fluid from the double acting fluid end 10.

In embodiments, a first housing 16 is provided to house a suction check valve 100S and a discharge check valve 100D. A second housing 18 is provided to house a second suction check valve 102S and discharge check valve 102D. Two fluid connections are provided between the first housing 16 and the second housing 18. The first fluid connection links the suction check valve 100S to the suction check valve 102S through a spool 32. The second fluid connection links the discharge check valve 100D to the discharge check valve 102D through a second spool 34.

In embodiments, the check valves 100S, 100D, 102S, 102D are self-contained units that may be placed within the first or second housing 16, 18 as appropriate. The self-contained units may be a cartridge style unit such that maintenance for the double acting fluid end 10 is superior compared to conventional apparatus. In embodiments, for example, cartridges may be simply removed and replaced by field personnel, greatly speeding maintenance actions. Although disclosed as a complex shape, as provided in FIG. 5, different shapes of check valves 100S, 100D, 102S, 102D may be used. These check valves may be tubular in shape, rectangular in shape or other types of geometric designs.

In embodiments, the double acting fluid end 10 may be made of metallic materials to provide for long-term and maintenance fee operation. Such materials may be, for example, stainless steel, carbon steel or other similar materials.

Figure 2:
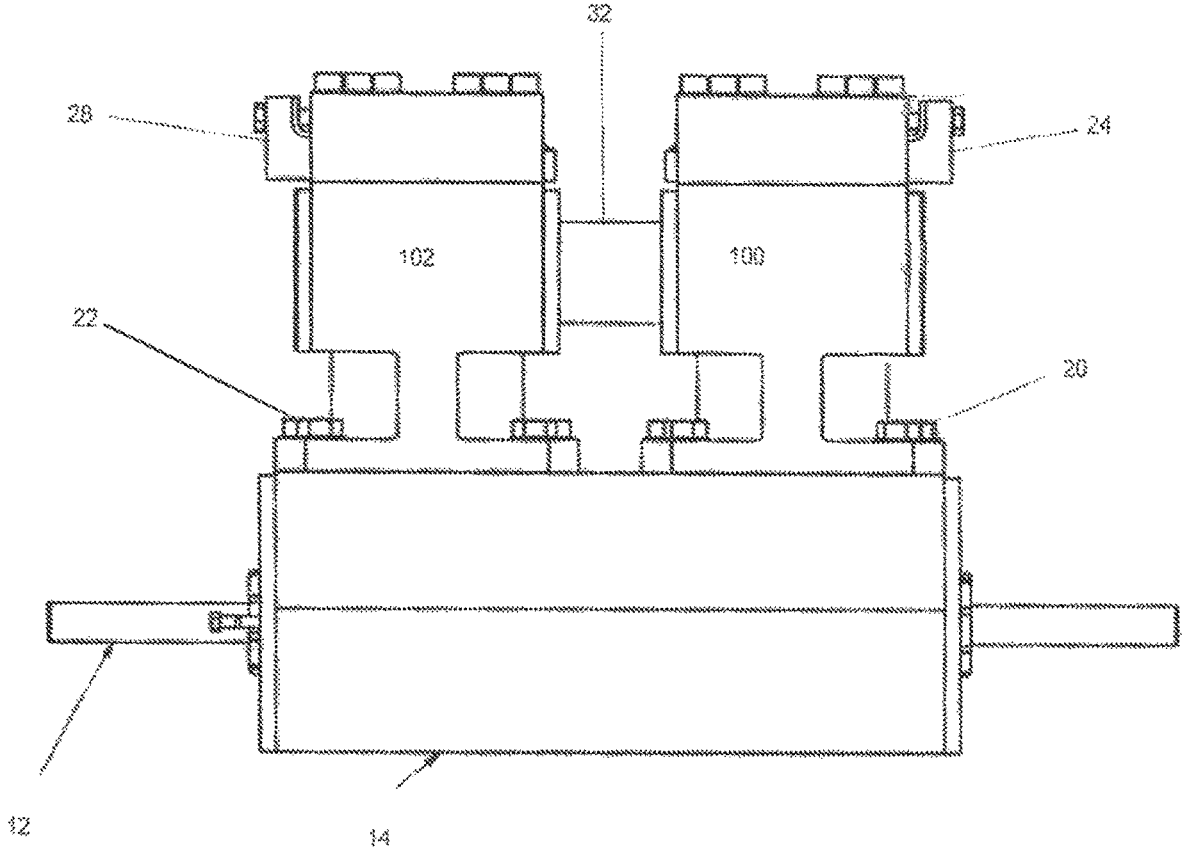
FIG. 2 is a side view of the double acting fluid end of FIG. 1.
Figure 5:
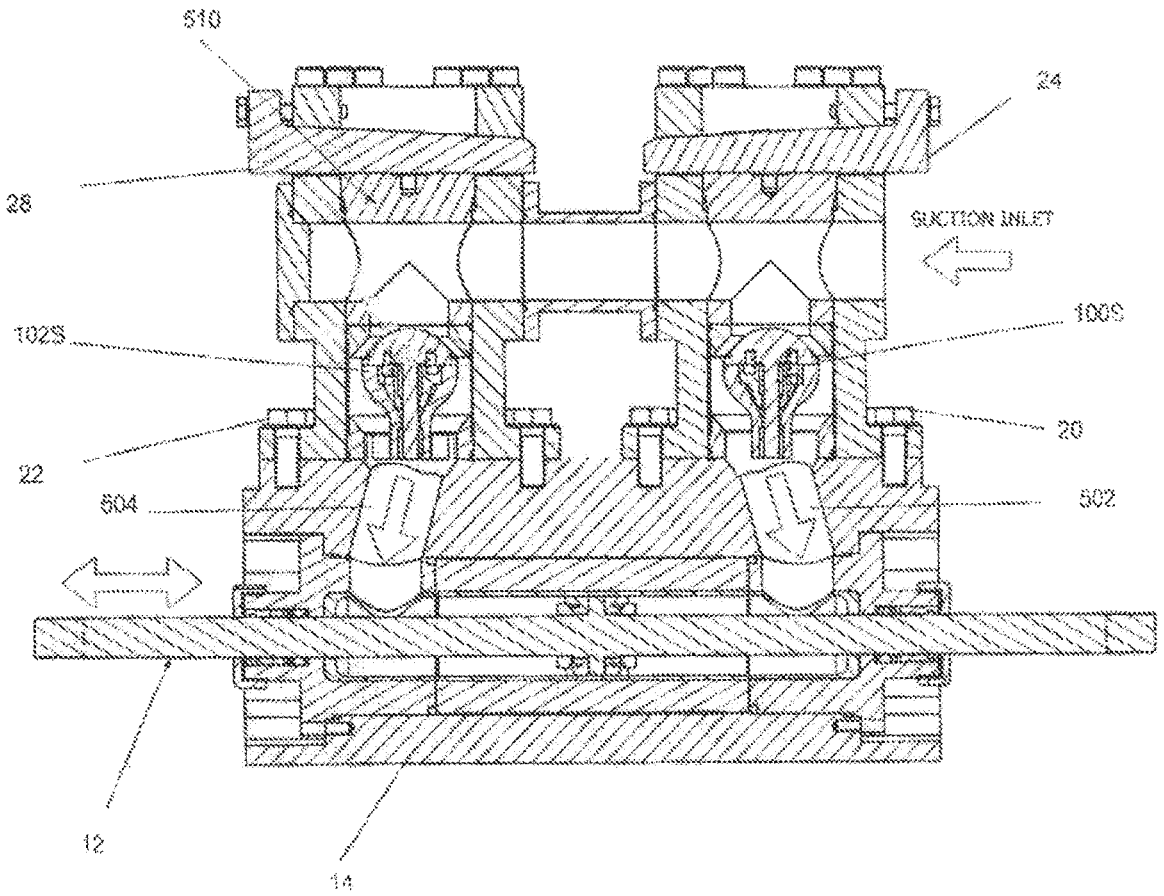
FIG. 5 is a cross-sectional view of the double acting fluid end of FIG. 1 in a suction cycle activity.

Referring to FIG. 2, a side view of the double acting fluid end 10 is illustrated. As illustrated, a fluid end block 14 is positioned to accept first bolted connection 20 and second bolted connection 22. Valves 100S, 100D, 102S, 102D are positioned within the housings 100, 102, as appropriate. A spool piece 32 allows for establishment of a fluid connection between the housing 100 and 102. Wedge lock apparatus 24, 26, 28, 30 (as shown in FIG. 1, FIG. 2 and FIG. 5) is configured to keep plugs 510 installed within the double acting fluid end 10 in place during operation. As will be understood, the wedge lock apparatus 24, 26, 28, 30 may contact a top face of the plugs within the double acting fluid end 10 to provide a retention of the plugs. The wedge lock apparatus 24, 26, 28, 30 may be configured with bolts to secure the wedge lock apparatus 24, 26, 28, 30 to the collared portion of the double acting fluid end 10.

Figure 3:
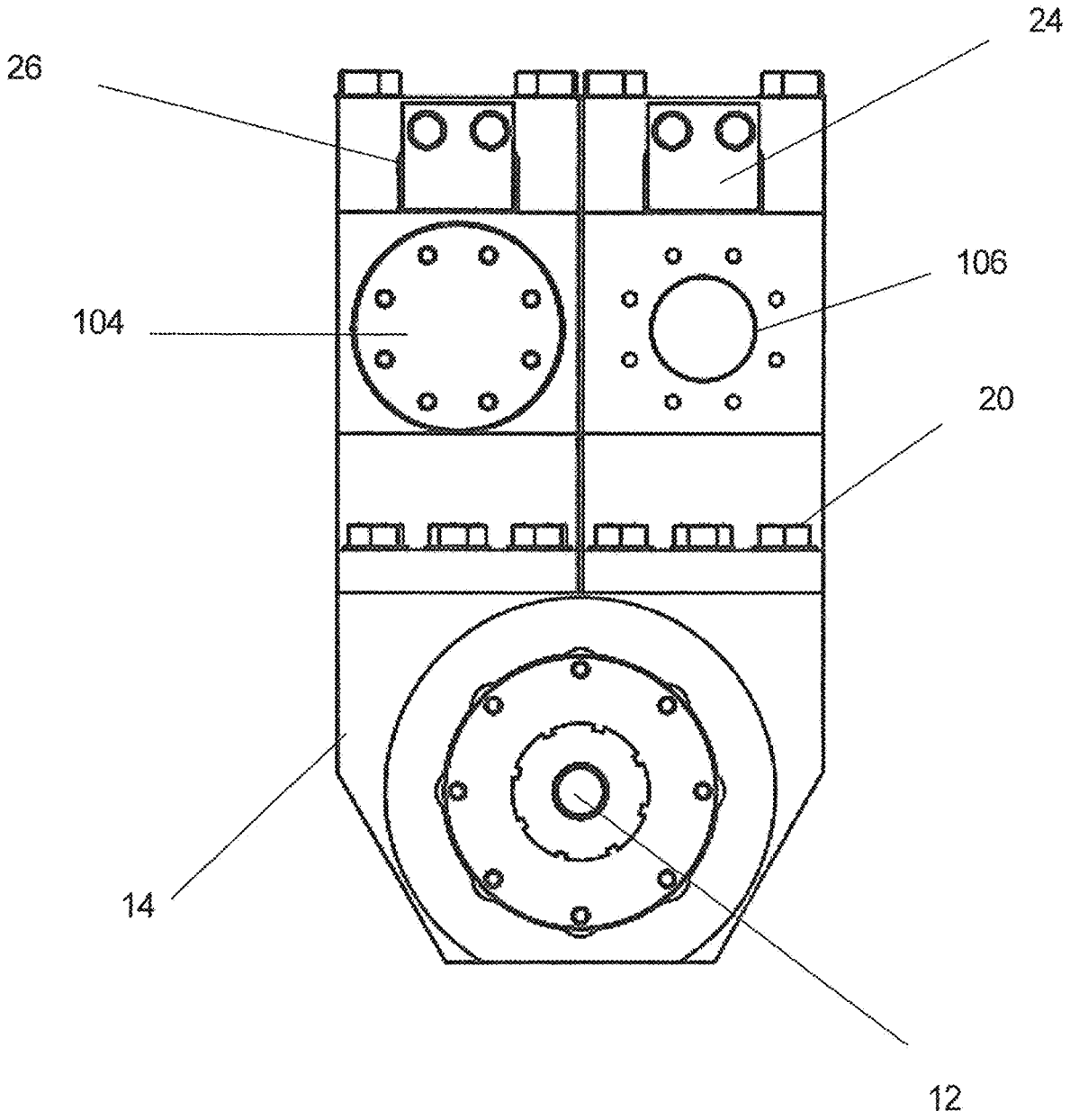
FIG. 3 is an end view of the double acting fluid end of FIG. 1.

Referring to FIG. 3, a side view of the double acting fluid end 10 is illustrated. In this side elevation view, the piston 12 is illustrated entering the fluid end block 14. A suction 106 is provided in one section for entrance of fluid into the double acting fluid end 10. A discharge 104 is also provided for discharge of fluid from the double acting fluid end 10. Both the suction 106 and the discharge 104 may be a bolted connection allowing for mechanical interlocking of the double acting fluid end 10 to fluid networks. By way of definition, fluid networks may include a piping system that is independent or part of another fluid delivery system.

Figure 4:
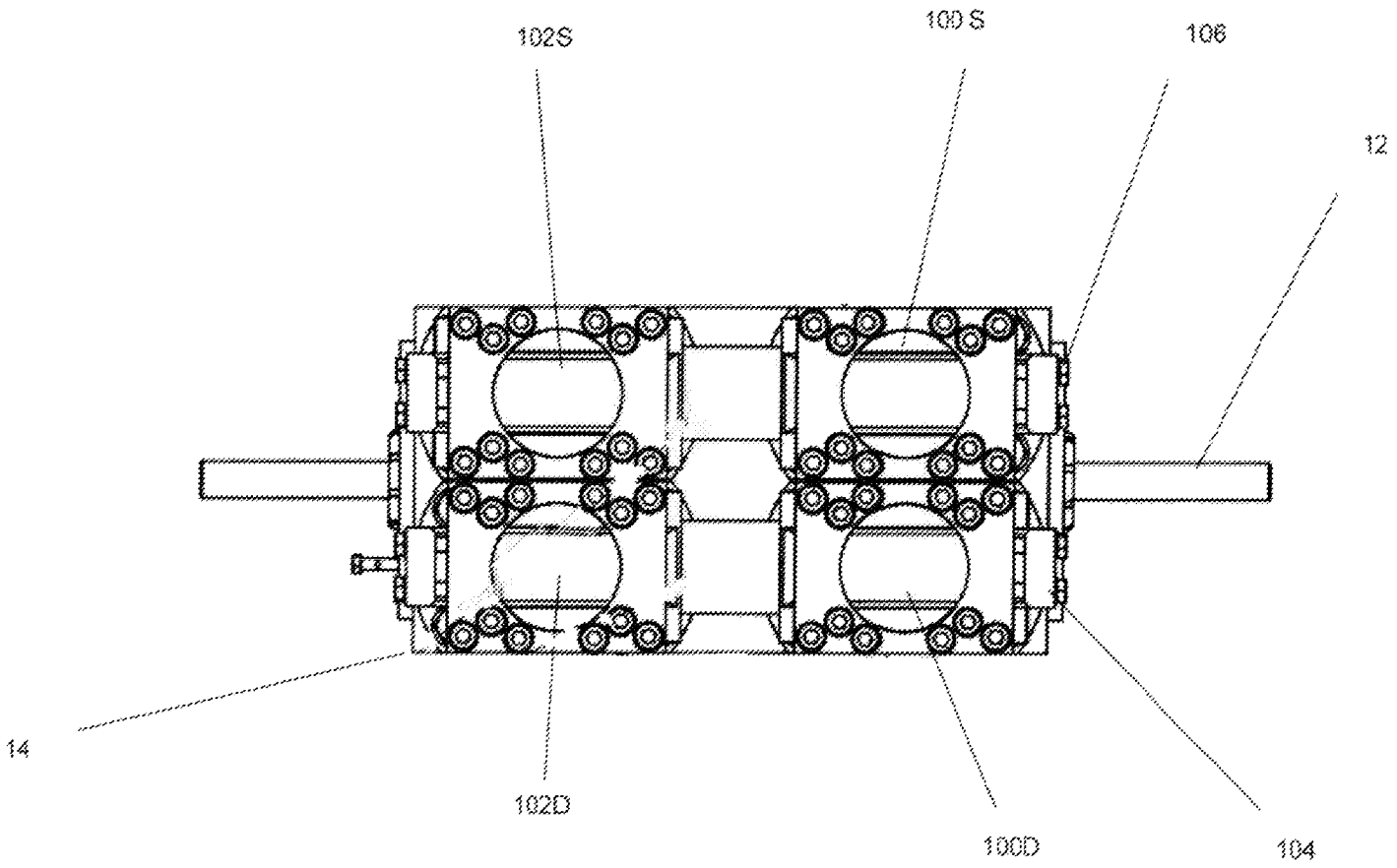
FIG. 4 is a top view of the double acting fluid end of FIG. 1.

Referring to FIG. 4, a top view of the double acting fluid end 10 is illustrated. As illustrated, two suction check valves 100S, 102S and two discharge check valves 100D, 102D are provided within the double acting fluid end 10. During actuation of the piston 12 within the housing 14, the check valves 100S, 102S, 100D and 102D may be open for communication of fluid through the double acting fluid end 10 or the piston 12 may prevent fluid flow from occurring.

Figure 6:
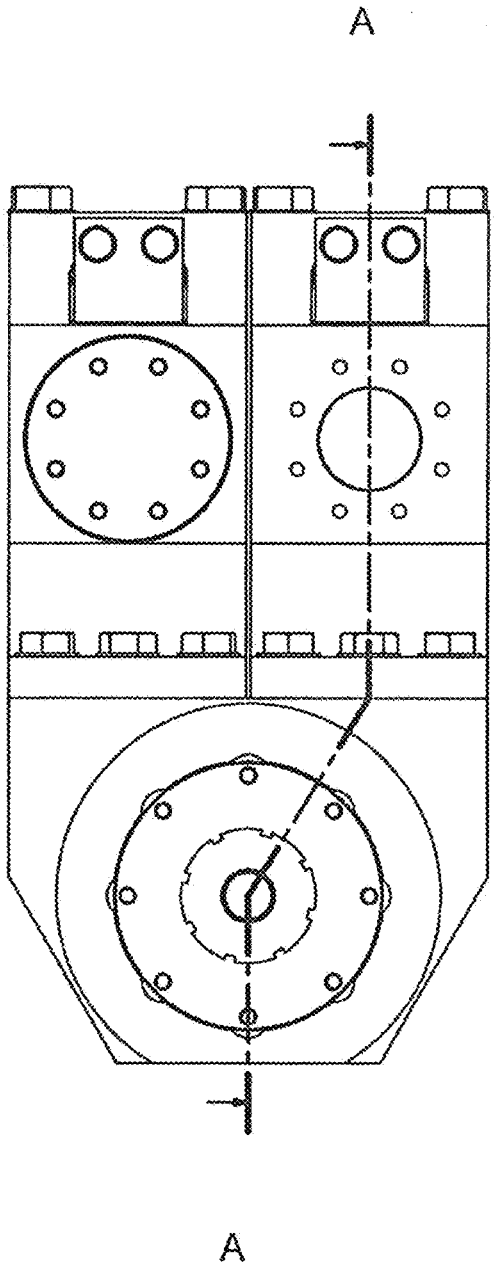
FIG. 6 is an end view of the double acting fluid end of FIG. 5.

Referring to FIG. 6, a side view of the double acting fluid end 10 is illustrated with cross-section line A-A. Cross-section line A-A is illustrated in more detail in FIG. 5, pertaining to a suction cycle for the double acting fluid end 10.

Referring to FIG. 5, a cross-section of the double acting fluid end 10 is illustrated along cross-section line A-A. As illustrated in FIG. 5, a suction cycle for the double acting fluid end 10 is illustrated. Fluid may flow, along directional line 500 into the double acting fluid end 10. Two suction check valves 100S, 102S are provided such that flow that enters the double acting fluid end 10 passes through the check valves 100S, 102S and down outlets 502 or 504. As the piston 12 is configured to oscillate back and forth inside the block 14, at some instances, either of the outlets 502, 504 may be blocked, thus limiting flow. Reciprocal motion of the piston 12 is noted by the double arrow placed at the bottom of FIG. 5. Reciprocating action of the piston 12 may be achieved by direct connection to a mechanical apparatus, such as a pump. In this embodiment, pre-existing reciprocating action can be beneficially used to channeling fluid flow, under high pressure, for use in a variety of ways.

Figure 7:
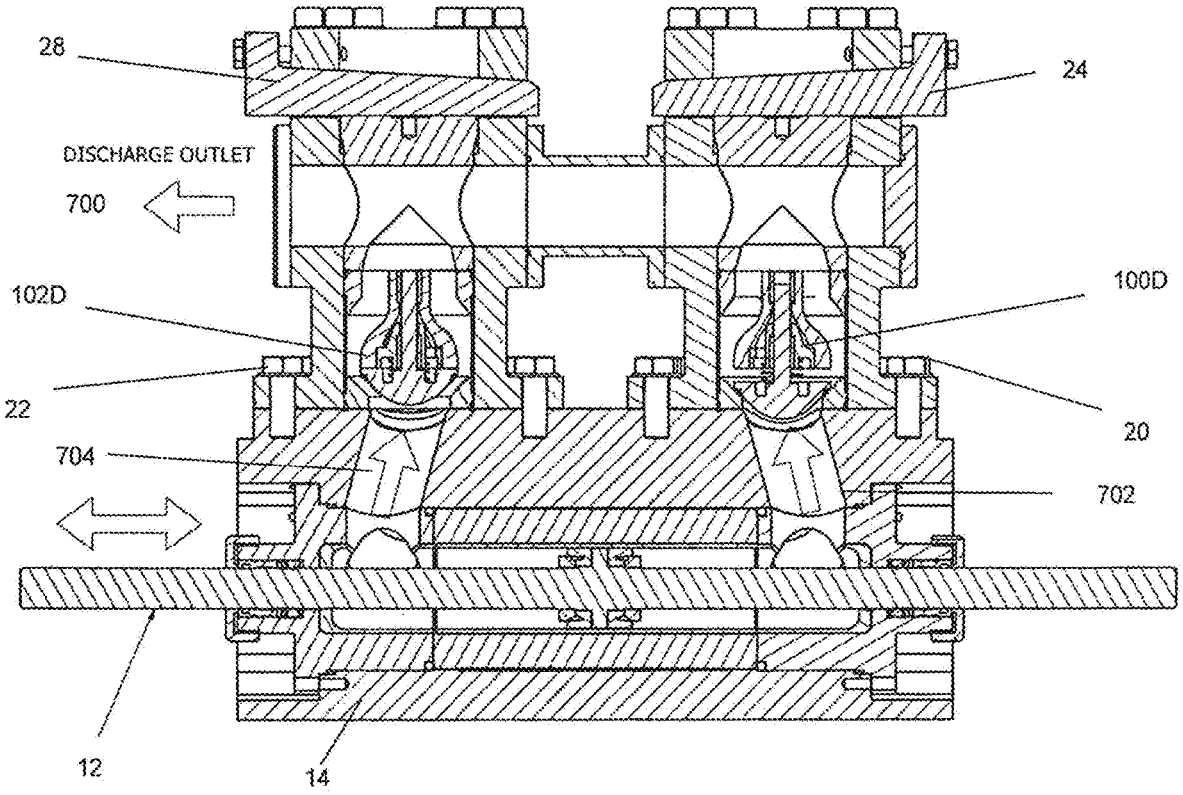
FIG. 7 is a cross-sectional view of the double acting fluid end of FIG. 1 in a pressure discharge activity.
Figure 8:
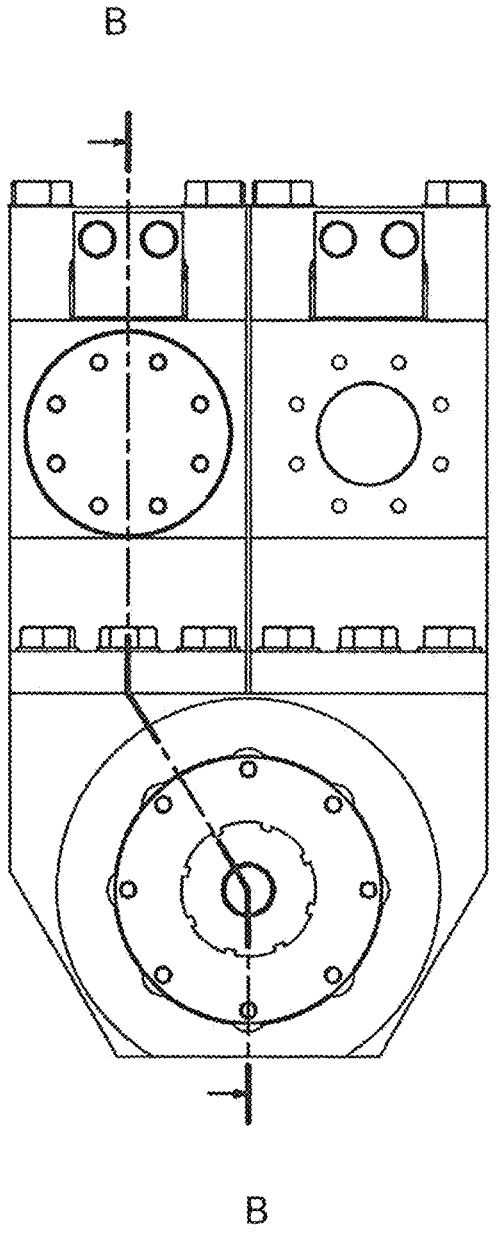
FIG. 8 is an end view of the double acting fluid end of FIG. 7.

Referring to FIG. 8, a side view of the double acting fluid end 10 is illustrated with cross-section line B-B. Cross-section line B-B is illustrated in more detail in FIG. 7, pertaining to a pressure discharge for the double acting fluid end 10.

Referring to FIG. 7, a cross-sectional view through line B-B is illustrated. In this cross-sectional view, the check valves 100D, 102D may be clearly viewed. The piston 12 may reciprocate back and forth through the block 14 through mechanical action provided. The mechanical action may be, for example, connection to a pump. During a pressure discharge, fluid may follow the paths shown by the arrows, through the discharge paths 702, 704, out the discharge 104. The check valves 100D, 102D may be drop in valves that are self-contained. Wedge lock apparatus 24, 28 may be provided to retain plugs within the fluid end 10. Fluid may exit through the discharge outlet line 700.

Figure 9:
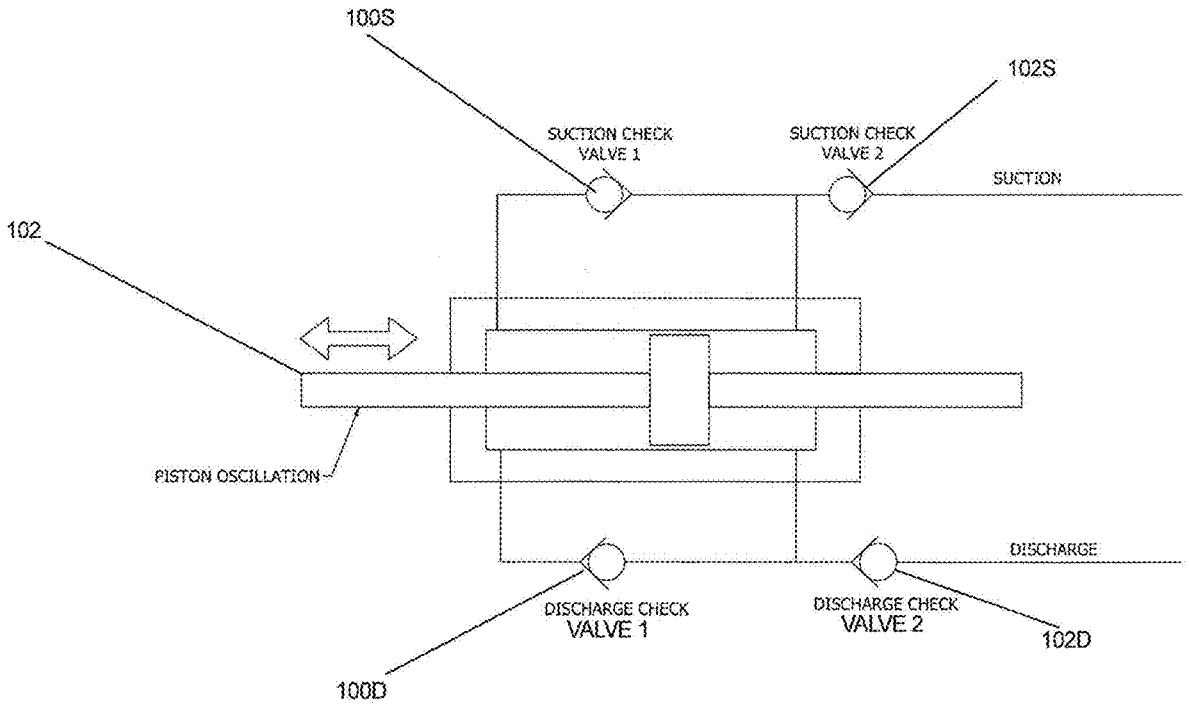
FIG. 9 is schematic representation of the double acting fluid end of FIG. 1.

Referring to FIG. 9, a schematic representation of the double acting fluid end 10 is illustrated. A suction line 104 is provided to a first suction check valve 100S and a second suction check valve 102S. A discharge line 106 is provided with a first discharge check valve 100D and a second discharge check valve 102D. Fluid may enter the double acting fluid end 10 through the suction line 104 and exit through the discharge line 106. The piston 12 may reciprocate in the block 14 wherein piston reciprocation is achieved using a motive force, for example, from an existing pump mechanism. Thus, at certain times, fluid pathways between the suction check valve 100S and discharge check valve 100D are functional or blocked depending upon the position of the piston 12. At other times, fluid pathways between the suction check valve 102S and discharge check valve 102D are functional or blocked, depending upon the position of the piston 12.

Figure 10:
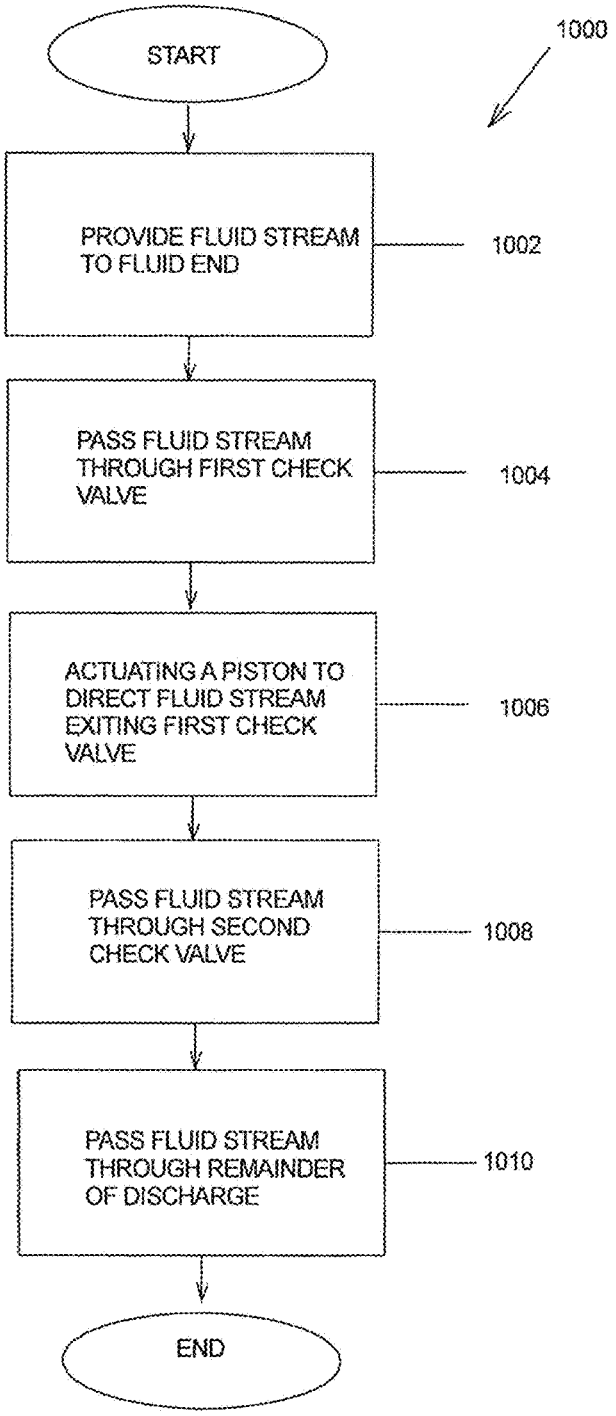
FIG. 10 is a method of operation of a double acting fluid end.

Referring to FIG. 10, a method 1000 is disclosed. The method 1000 may comprise, at 1002 providing a fluid stream to a first fluid end. At 1004, the method may provide for passing the fluid stream through a first check valve. At 1006, the method may provide for actuating a piston to direct the fluid stream to a desired discharge of the first fluid end. At 1008, the method may provide for passing the fluid stream through a second check valve in the desired discharge. At 1010, the method may provide for passing the fluid stream through a remainder of the desired discharge.

Figure 11:
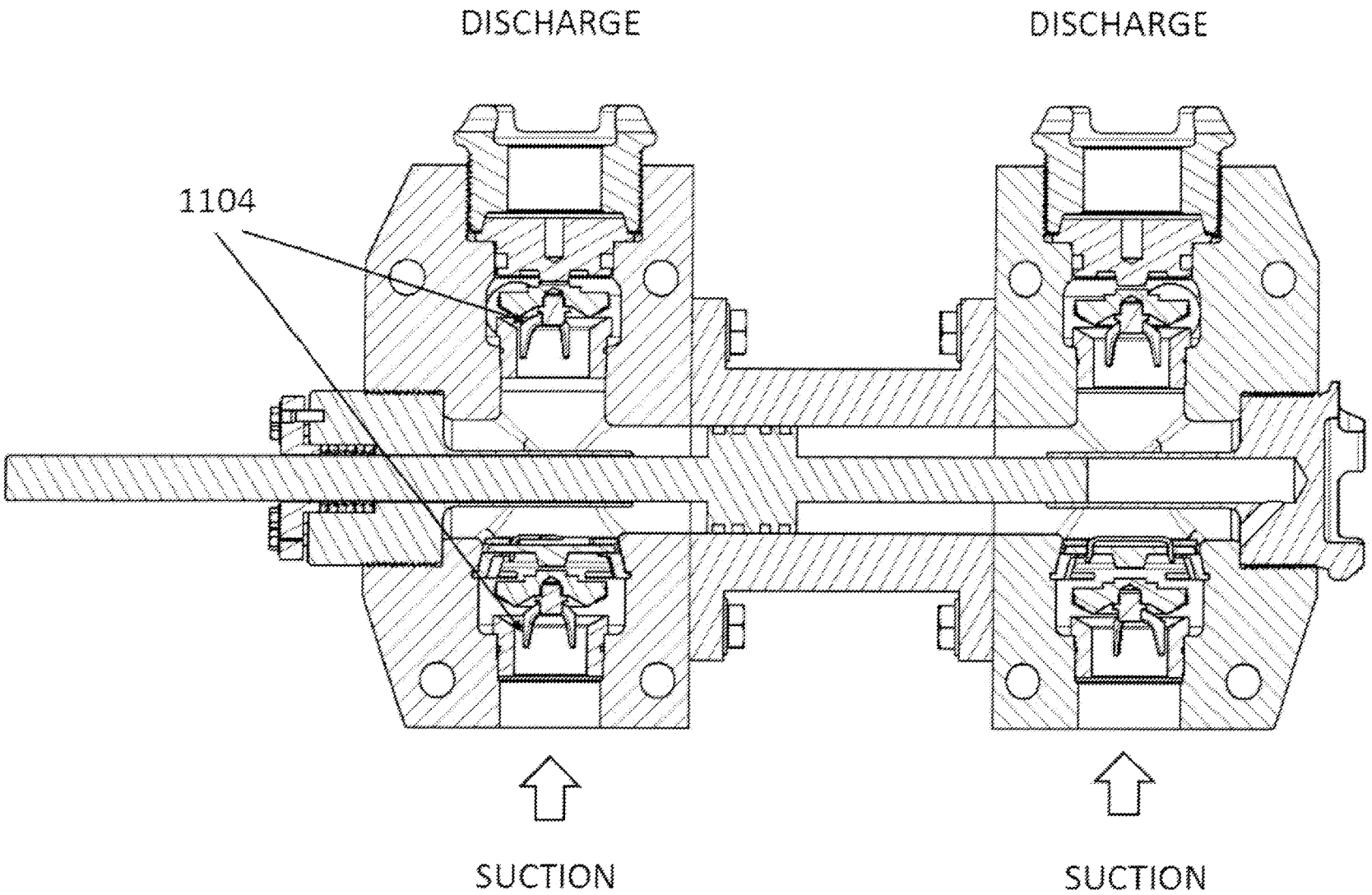
FIG. 11 is a second example embodiment of a double acting fluid end in accordance with another example embodiment, wherein a piston is traveling toward a right most check valve arrangement.

FIG. 11 is a second example embodiment of a double acting fluid end in accordance with another example embodiment of the disclosure. In this embodiment, two fluid ends are arranged in a "back to back" arrangement. In this configuration, a piston is configured to translate between the left most fluid end and the right most fluid end. In FIG. 11, the arrangement discloses that the piston is traveling toward the right most fluid end, with the suction side of the fluid end at the bottom and the discharge end of the fluid end at the top. Through the use of the check valve, pressure transferred to the right most discharge side is transmitted out of the right most fluid end. The use of a check valve in this configuration prevents back pressure from building within the fluid end and over pressurizing the piston.

Figure 12:
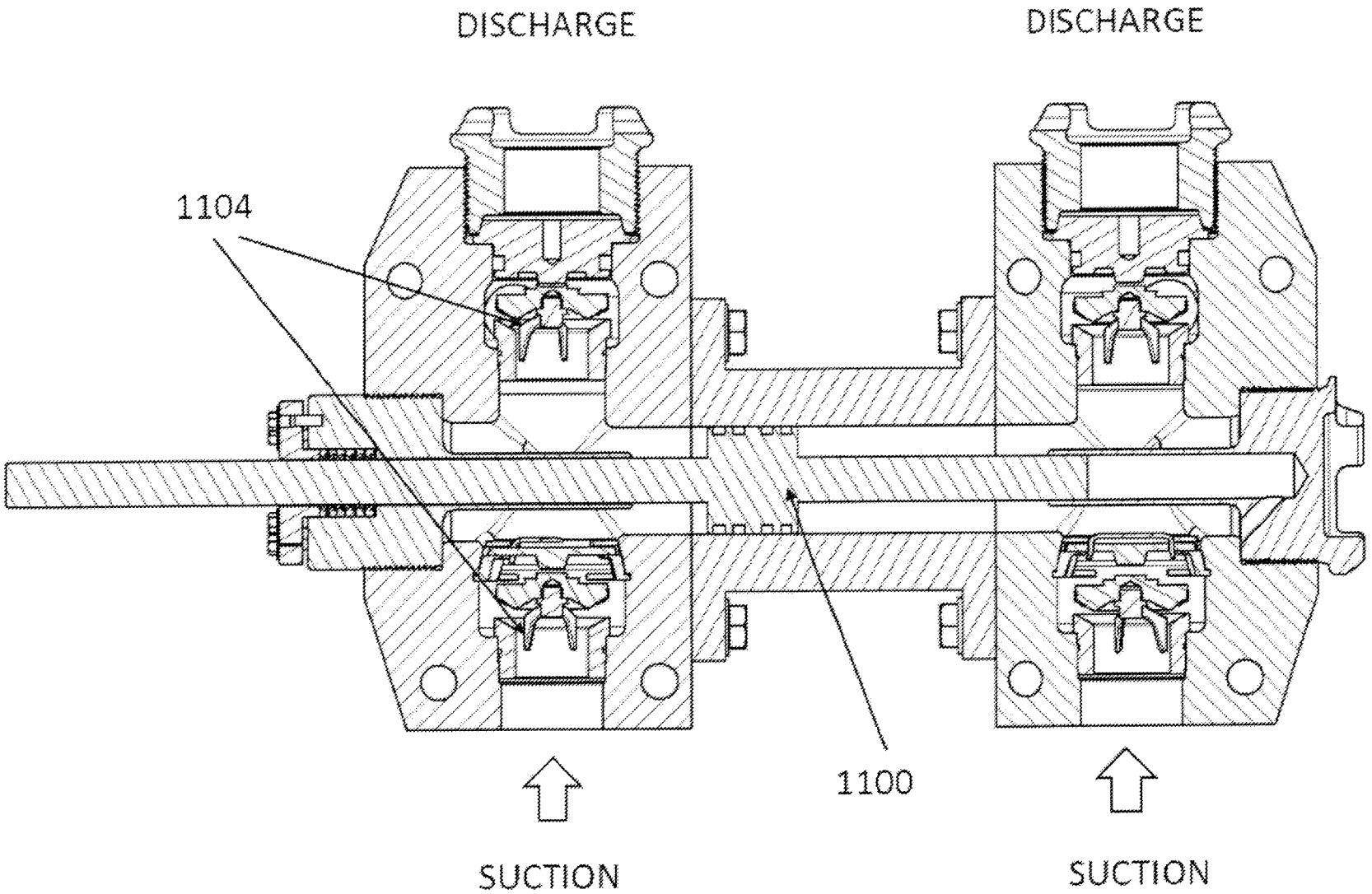
FIG. 12 is a view of the second example of the double acting fluid end of FIG. 11, wherein the piston is traveling toward a left most check valve arrangement.

FIG. 12 is a further example embodiment of the arrangement of FIG. 11, wherein the piston has now traveled to the left most fluid end. In a similar arrangement, a check valve allows for the transfer of pressure to the discharge end of the fluid end, while prohibiting back pressure from being exerted upon the piston. As can be seen, the suction or intake side of the fluid end is similarly at the bottom, thereby providing a matching intake and discharge mirror image.

Sealing of the piston and piston rod to the block may be achieved by a gland seal that is appropriate for the pressure present. In the embodiments shown in FIG. 11 and FIG. 12, four different check valves may be used in the double acting fluid end. As with previous embodiments, the check valves may be any geometrical shape to fit within the double acting fluid end. The check valves may be, for example, cartridge type units that will allow maintenance personnel to insert or remove cartridges quickly and efficiently. As can be seen below, using embodiments of the disclosure can provide for increased volumes of fluid pumped and/or pressure while keeping the power within established parameters. The examples below, illustrates the benefits to a 2200 hp rated pump. As can be seen in the example embodiments 2, 3, 4, different aspects/parameters may be augmented, illustrating the corresponding responses in the system. For example, example 2 shows the changes in operating parameters when an increase in pressure is seen.

TABLE 1

| | Pump | Speed (RPM) | Pressure (psi) | Rod Load (lb ft) | Volume (gpm) | Power (hp) |
|---|---|---|---|---|---|---|
| 1 | Current 14P 5" 7500 psi | 105 | 7500 | 147262 | 374.8 | 1641 |
| 2 | GARTECH 5" × 2½" 10000 psi (Increase pressure) | 70 | 10000 | 147262 | 374.8 | 2187 |
| 3 | GARTECH 5" × 2½" 7500 psi (less Speed/ Rod Load) | 70 | 7500 | 110447 | 374.8 | 1641 |
| 4 | GARTECH 5" × 2½" 7500 psi (more flow rate with HP limit) | 93 | 7500 | 110447 | 498.0 | 2180 |

Aspects of the disclosure provide for many advantages compared to conventional apparatus. These advantages include:

- Modular design for the Fluid End Block and the suction/discharge modules
- Most components in the Suction/Discharge blocks are interchangeable (only flow plugs vary slightly)
- Check Valve is the same for both Suction and Discharge
- Check Valve is a Cartridge design, enabling complete assembly and removeable as one unit. (Worn units have potential to be refurbished depending on wear)
- Check valve has a double bearing guidance to ensure longevity of operation
- Flow through the Check Valve is optimized to promote a smooth turbulent free flow (less pressure drop)
- Depending on setup flow, rod load and HP cap be optimized to maximize pump operation and performance benefits
- The wedge type retention for the flow plug/check valve is easily removed and re-assembled, without the need for hammer unions (current technology), resulting in a safer and less demanding operation.
- Fluid End Block has a simpler design, resulting in less complicated machining. Low discontinuity in internal profiles make the block less susceptible to fatigue cracking (a known issue with current fluid ends), resulting in longer life
- Liner/Piston parts can be accessed from the front of the pump
- Design caters for 5" thru to 7½" via liner/piston change.

In one example embodiment, an arrangement is disclosed. The arrangement may comprise a block with at least one void. The arrangement may further comprise a piston located within the at least one void in the block, the piston configured to translate from a first position to a second position. The arrangement may further comprise a first housing connected to the block, the first housing having a suction side and a discharge side. The arrangement may further comprise a second housing connected to the block, the second housing having a suction and a discharge side. The arrangement may further comprise at least a first suction check valve and a first discharge check valve located in the first housing. The arrangement may further comprise at least a second suction check valve and a second discharge check valve located in the second housing.

In another example embodiment, the arrangement may be configured wherein the translation of the piston from the first position to the second position occurs through a mechanical connection.

In another example embodiment, the arrangement may be configured wherein the mechanical connection is to a pump.

In another example embodiment, the arrangement may be configured wherein the first housing is connected to the block through a first bolted connection.

In another example embodiment, the arrangement may be configured wherein the second housing is connected to the block through a second bolted connection.

In another example embodiment, the arrangement may be further configured with at least one wedge lock arrangement configured to retain a plug within a fluid end.

In another example embodiment, the arrangement may be configured wherein the at least one wedge lock arrangement is further configured with at least one bolt arrangement configured to attach the at least one wedge lock arrangement to one of the first housing and the second housing.

In another example embodiment, an arrangement is disclosed. The arrangement may comprise a first block for a first fluid end with at least one void and a second block for a second fluid end with at least one void. The arrangement may further comprise a piston located between the first fluid end and the second fluid end, the piston configured to translate from a first position to a second position. The arrangement may also comprise a first housing connected to the first block, the first housing having a suction side and a discharge side. The arrangement may also comprise a second housing connected to the second block, the second housing having a suction and a discharge side. The arrangement may also comprise at least a first suction check valve and a first discharge check valve located in the first housing. The arrangement may also comprise at least a second suction check valve and a second discharge check valve located in the second housing.

In another example embodiment, the arrangement may be configured wherein the translation of the piston from the first position to the second position occurs through a mechanical connection.

In another example embodiment, the arrangement may be configured wherein the mechanical connection is to a pump.

In another example embodiment, the arrangement may be configured wherein the first housing is connected to the block through a first bolted connection.

In another example embodiment, the arrangement may be configured wherein the second housing is connected to the block through a second bolted connection.

In another example embodiment, the arrangement may further comprise at least one wedge lock arrangement configured to retain a plug within the first fluid end.

In another example embodiment, the arrangement may further comprise at least four wedge lock arrangements configured to retain at least four plugs within the first and second fluid ends.

In another example embodiment, a method is disclosed. The method may provide for providing a fluid stream to a first fluid end. The method may also provide for passing the fluid stream through a first check valve. The method may also provide for actuating a piston to direct the fluid stream to a desired discharge of the first fluid end. The method may also provide for passing the fluid stream through a second check valve in the desired discharge. The method may also provide for passing the fluid stream through a remainder of the desired discharge.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may be varied in many ways. Such variations are not to be regarded as a departure from the disclosure, and all such modifications are intended to be included within the scope of the disclosure.

While embodiments have been described herein, those skilled in the art, having benefit of this disclosure, will appreciate that other embodiments are envisioned that do not depart from the inventive scope. Accordingly, the scope of the present claims or any subsequent claims shall not be unduly limited by the description of the embodiments described herein.

What is claimed is:

1. An arrangement, comprising:

a block with at least one void;

a piston located within the at least one void in the block, the piston configured to translate from a first position to a second position;

a first housing connected to the block, the first housing having a suction side and a discharge side;

a second housing connected to the block, the second housing having a suction side and a discharge side;

at least a first suction check valve and a first discharge check valve located in the first housing;

at least a second suction check valve and a second discharge check valve located in the second housing; wherein the piston is configured to pump a liquid on both a compression stroke and a suction stroke of the piston; and at least one wedge lock apparatus configured to retain a plug within a fluid end, wherein the plug is configured to fit within the block, each of the at least one wedge lock apparatus configured to contact a top face of the plug located within one of the first housing and the second housing and wherein each wedge lock apparatus is configured in an inclined wedge shape with flange and wherein the wedge lock apparatus is configured with a mechanical connection that connects the wedge lock apparatus to the fluid end through the flange and wherein the plug is retained within the fluid end through contact of a bottom face of the wedge lock apparatus, wherein each wedge lock apparatus is configured perpendicular to a direction of fluid flow.

2. The arrangement according to claim 1, wherein the translation of the piston from the first position to the second position occurs through a mechanical connection.

3. The arrangement according to claim 2, wherein the mechanical connection is to a pump.

4. The arrangement according to claim 1, wherein the first housing is connected to the block through a first bolted connection.

5. The arrangement according to claim 1, wherein the second housing is connected to the block through a second bolted connection.

6. The arrangement according to claim 1, wherein the at least one wedge lock apparatus is further configured with at least one bolt arrangement configured to attach the at least one wedge lock arrangement to one of the first housing and the second housing.

* * * * *